US011117600B2

(12) United States Patent
Sunde et al.

(10) Patent No.: US 11,117,600 B2
(45) Date of Patent: Sep. 14, 2021

(54) HYBRID CUSHIONING APPARATUS WITH DRAFT GEAR

(71) Applicant: Strato, Inc., Piscataway, NJ (US)

(72) Inventors: Jonathan Sunde, Someret, NJ (US); Michael Ring, Lake Village, IN (US)

(73) Assignee: Strato, Inc., Piscataway, NJ (US)

( * ) Notice: Subject to any disclaimer, the term of this patent is extended or adjusted under 35 U.S.C. 154(b) by 375 days.

(21) Appl. No.: 16/206,097

(22) Filed: Nov. 30, 2018

(65) Prior Publication Data

US 2020/0172128 A1 Jun. 4, 2020

(51) Int. Cl.
*B61G 9/04* (2006.01)
*B61G 9/20* (2006.01)

(52) U.S. Cl.
CPC ..... *B61G 9/04* (2013.01); *B61G 9/20* (2013.01)

(58) Field of Classification Search
CPC ... B61G 9/04; B61G 9/06; B61G 9/12; B61G 9/14; B61G 9/20
See application file for complete search history.

(56) References Cited

U.S. PATENT DOCUMENTS

| | | | | |
|---|---|---|---|---|
| 2,469,126 | A | 5/1949 | Munro et al. | |
| 2,559,743 | A | 7/1951 | Williams | |
| 2,706,050 | A | 4/1955 | Sprouse | |
| 2,728,465 | A | 12/1955 | Campbell | |
| 2,766,894 | A | 10/1956 | Campbell | |
| 2,825,472 | A | 3/1958 | Peterson | |
| 2,970,703 | A | 2/1961 | Blattner | |
| 3,197,037 | A | 7/1965 | Willison | |
| 3,370,718 | A | 2/1968 | Waddell | |
| 3,622,015 | A | 11/1971 | Atkinson et al. | |
| 3,712,479 | A | 1/1973 | Atkinson | |
| 3,800,961 | A | 4/1974 | Hawthorne | |
| 3,827,575 | A | 8/1974 | Mosier et al. | |
| 3,838,778 | A | 10/1974 | Appleton | |
| 5,312,007 | A * | 5/1994 | Kaufhold | B61G 7/10 213/75 R |
| 5,487,480 | A | 1/1996 | Page et al. | |
| 6,360,906 | B1 | 3/2002 | Kaufhold et al. | |
| 6,446,820 | B1 | 9/2002 | Barker et al. | |
| 6,681,943 | B2 | 1/2004 | Barker et al. | |
| 8,590,717 | B2 | 11/2013 | Wilt et al. | |
| 8,870,002 | B2 | 10/2014 | Wilt et al. | |
| 8,939,300 | B2 | 1/2015 | Wilt et al. | |
| 8,985,355 | B2 | 3/2015 | Wilt | |
| 9,056,618 | B2 | 6/2015 | Gagliardino et al. | |
| D781,179 | S | 3/2017 | Schoedl et al. | |

(Continued)

FOREIGN PATENT DOCUMENTS

| | | |
|---|---|---|
| GB | 919899 | 2/1963 |

OTHER PUBLICATIONS

International Search Report and Written Opinion of corresponding PCT application No. PCT/US19/63837 dated Feb. 18, 2020.

(Continued)

*Primary Examiner* — Robert J McCarry, Jr.
(74) *Attorney, Agent, or Firm* — AP Patents; Alexander Pokot

(57) ABSTRACT

A hybrid cushioning apparatus for a railway car apparatus employs a standard yoke and a conventional draft gear forward of the tail of the yoke and a stack of elastomeric units behind the tail engaging the draft gear with a force transfer member.

18 Claims, 3 Drawing Sheets

(56) References Cited

U.S. PATENT DOCUMENTS

| | | | |
|---|---|---|---|
| 9,598,092 | B2 | 3/2017 | James et al. |
| 9,669,848 | B2 | 6/2017 | Creighton et al. |
| 9,789,888 | B2 | 10/2017 | Wilt et al. |
| 9,868,453 | B2 | 1/2018 | Johnson et al. |
| 10,011,288 | B2 | 7/2018 | Gagliardino et al. |
| 10,086,852 | B2 | 10/2018 | Iler |
| 10,308,263 | B1 | 6/2019 | Ring et al. |
| 10,513,042 | B2 | 12/2019 | Ring et al. |
| 2002/0070189 | A1 | 6/2002 | Barker et al. |
| 2006/0043044 | A1 | 3/2006 | Ring et al. |
| 2008/0008225 | A1 | 1/2008 | Ahmad et al. |
| 2008/0011700 | A1 | 1/2008 | Brough et al. |
| 2013/0270210 | A1 | 10/2013 | Kukulski et al. |
| 2015/0251671 | A1 | 9/2015 | Iler |
| 2015/0307115 | A1 | 10/2015 | Wang et al. |
| 2017/0080956 | A1 | 3/2017 | James et al. |
| 2017/0166225 | A1 | 6/2017 | Schoedl et al. |
| 2017/0210398 | A1 | 7/2017 | Wilt et al. |
| 2017/0334469 | A1 | 11/2017 | Johnson et al. |
| 2018/0118235 | A1 | 5/2018 | Johnson et al. |
| 2019/0144015 | A1 | 5/2019 | Ring et al. |

OTHER PUBLICATIONS

International Search Report and Written Opinion of corresponding PCT application No. PCT/US19/66441 dated Feb. 14, 2020.

* cited by examiner

HYBRID CUSHIONING APPARATUS WITH DRAFT GEAR

BACKGROUND OF THE INVENTION

In a conventional frictional draft gear, one or more elastic elements, such as a coil spring or a set of elastomeric pads, is enclosed in a housing mounted in the yoke behind the coupler of a railway car. A piston-like element frictionally received in the housing absorbs buff loads transmitted via a coupler follower which moves inside the yoke in response to buff impact force applied on the coupler, and the draft gear is compressed in the yoke in response to buff and draft forces. The basic draft gear apparatus has been used for decades. However, in many cases unacceptably large forces are transmitted to the railway car and it is now desired to provide a cushioning apparatus that dissipates more force during impact than the conventional draft gear.

A solution has recently been proposed in U.S. Pat. No. 10,086,852 (which is incorporated by reference) to add a second draft gear into a railway car sill behind a standard yoke to absorb buff loads. However, the dual draft gear solution may not provide sufficient energy absorption. Merely doubling the 3¼ inches of travel provided by a single draft gear may not provide sufficient travel.

Selective cushioning apparatuses using elastomeric pads arranged on plates to absorb buff and draft loads on a coupler are described in co-pending application Ser. No. 15/814,853, filed Nov. 16, 2017 and Ser. No. 16/133,085, filed Sep. 17, 2018, which are incorporated by reference.

U.S. Patent Application Publication No. 2017/0210398 is incorporated by reference herein for its teaching of draft gear functioning and measurement of energy absorption.

SUMMARY OF THE INVENTION

The invention is directed to a hybrid cushioning apparatus for a railway car that absorbs more energy from buff loads applied to the coupler of a railway car compared to a conventional draft gear. In embodiments, the cushioning apparatus according to the invention is adapted to fit in a pocket size adapted for dual draft gears while providing greater cushioning than dual draft gears. The apparatus comprises a conventional draft gear forward of the tail of a standard yoke, and a stack of elastomeric units behind the tail of the yoke. Different embodiments employ different engagement between the draft gear and the stack of elastomeric units via a force transfer member.

In one aspect, the invention is an end-of-car cushioning apparatus for a railway car, comprising: a yoke having a nose at one end, a tail comprising a transverse tail wall opposite the nose, side walls ("straps") extending from the tail wall to the nose, and an inside area between the straps. A draft gear is positioned in the inside area of the yoke, the draft gear having a housing, a spring element within the housing, and a piston abutting the spring element and adapted to move within the housing against a force of the spring element. The apparatus further includes a force transfer member having side walls and a transverse wall between the side walls, the transverse wall being aligned with the tail wall of the yoke, so that the side walls of the force transfer member abut the base of the housing of the draft gear where it extends on both sides of the tail wall. A stack comprising at least two elastomeric units is positioned behind and adjacent the transverse wall of the force transfer member and extends from the yoke in a direction away from the nose. In embodiments, each plate of the stack has substantially the same vertical cross-sectional area. With this arrangement, the stack of elastomeric units may be aligned in the railway car sill, and buff forces on the coupler are absorbed initially by the draft gear and the stack of elastomeric units.

In another aspect of the invention, a stack of elastomeric units (sometimes referred to as a buff stack) is integrated with the force transfer member by a connecting rod passing through an aperture in the force transfer member and through the stack of plates. In this aspect, the invention is implemented with a single piece of metal (such as a cast iron or steel fitting) comprising: two parallel side walls having a distance between them to accommodate a tail of a railway car yoke; a transverse wall between the side walls having an aperture, the aperture having a recess around it to provide a flush mount for a connecting rod passing through the aperture. Each side wall of the force transfer member is sized to abut an opposed side of a railway car draft gear extending beyond the tail of the yoke on opposite sides of the yoke. A connecting rod passes through the aperture in the transverse wall to attach a stack of elastomeric units to the force transfer member.

BRIEF DESCRIPTION OF THE FIGURES

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1:
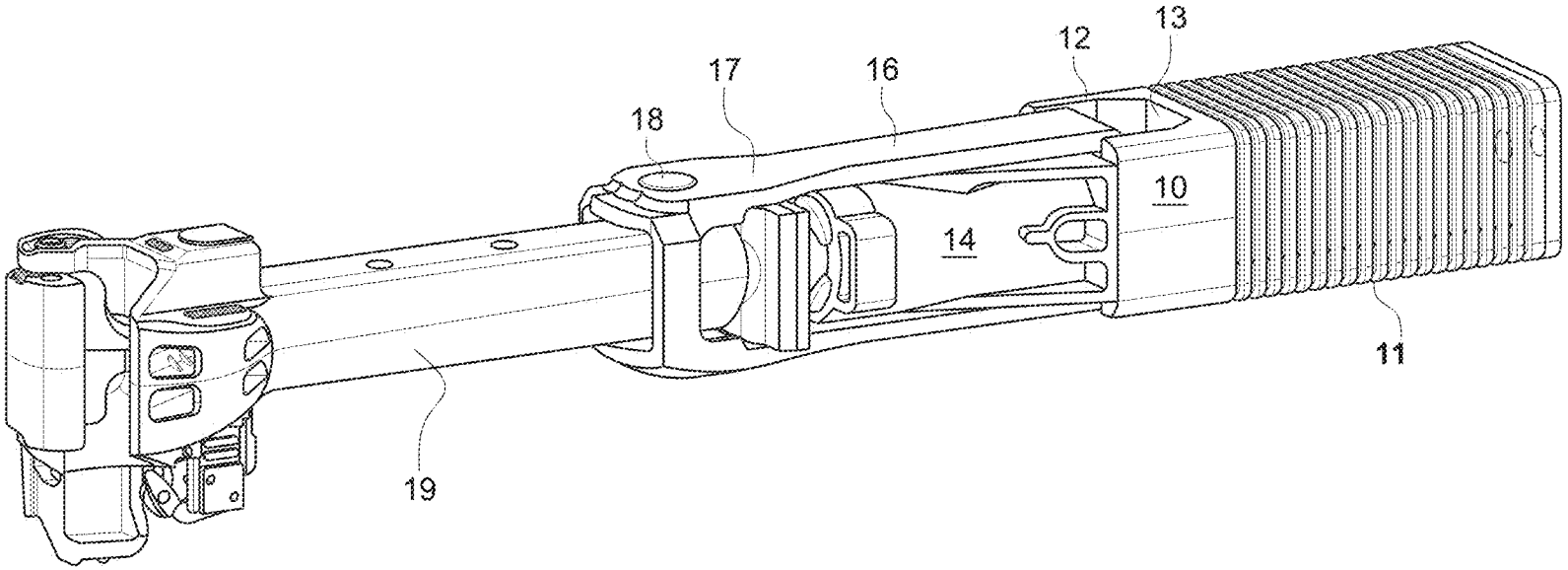
FIG. 1 depicts a hybrid cushioning unit with draft gear according to an embodiment of the invention.

The drawings are schematic and may not be to scale and features not necessary for an understanding of the invention are not shown.

DETAILED DESCRIPTION OF THE INVENTION

Directions and orientations herein refer to the normal orientation of a railway car in use. Thus, unless the context clearly requires otherwise, the "front" of a coupler is in a direction away from the body of the car and "rear" is in the opposite direction, from the front end of the coupler toward the car body. Likewise, the "longitudinal" axis or direction is parallel to the rails and in the direction of movement of the railway car on the track in either direction. The "transverse" or "lateral" axis or direction is perpendicular to the longitudinal axis and parallel to the rail. A "transverse plane" is a plane perpendicular to the longitudinal axis. The term "inboard" means toward the center of the car, and may mean inboard in a longitudinal direction, a lateral direction, or both. Similarly, "outboard" means away from the center of the car. "Vertical" is the up-and-down direction, and "horizontal" is a plane parallel to the surface the train travels on. A "vertical cross-section" of the sill, yoke or cushioning unit is in a plane parallel with the front of the railway car, which is also a transverse plane.

"Buff force" on the coupler means force applied when the coupler is urged in the inboard direction of the railway car, as when two railway cars impact one another. "Buff travel" refers to displacement of any element of the cushioning unit in response to buff force. "Draft force" is opposite to buff force and is applied to a coupler when a locomotive pulls on a railway car train, for example. "Neutral" refers to the position of components before buff or draft forces are applied. Some elements and components of the invention, including the elastomeric pads, may be pre-stressed and pre-biased in the neutral condition.

"Elastomer" and "elastomeric" refer to polymeric materials having elastic properties so that they exert a restoring force when compressed. Examples of such materials include, without limitation, thermoplastic elastomer (TPE), natural and synthetic rubbers such as: neoprene, isoprene, butadiene, styrene-butadiene rubber (SBR), polyurethanes, and derivatives. Thermoplastic copolyesters used in some conventional draft gear may be used in the stacks of elastomeric units according to the invention.

As used herein, some components are described as being "substantially parallel" to the tail of the yoke. As used herein, this means generally aligned with a vertical cross section of the sill, notwithstanding that the tail of the yoke is curved. Likewise, a plate may be "aligned with" or "substantially parallel" to a transverse plane, notwithstanding that the plate may have surface features. Thus, the tail wall of a yoke is understood to be aligned with and substantially parallel to a transverse plane perpendicular to the longitudinal axis of the coupler, irrespective of the curve in the tail. Each plate in a stack of elastomeric units is aligned with and substantially parallel to a transverse plane perpendicular to the longitudinal axis, irrespective of surface features on the plate.

As used herein, the term "about" associated with a numerical value is understood to indicate a margin of +/−20% of the value. With reference to specific standards, given dimensions vary at least within accepted tolerances.

"Travel" refers to a distance traveled by the coupler follower upon impact and may also be referred to as "displacement". In some instances, clear from the context, "travel" refers to the full possible extent of movement, i.e., when the pads are fully compressed.

A person having ordinary skill in the art has a general knowledge of standards and procedures established by the Association of American Railroads ("AAR") and the published AAR standards cited herein are incorporated by reference as background. Reference herein to AAR standards refers to standards in effect on the filing date of this application. Draft gears for freight cars are certified under either section M-901E or section M-901G of the Association of American Railroads (AAR) Manual. An E-Type yoke has the dimensions specified in AAR Standard S-149, which allows for a draft gear pocket of 24⅝ inch. An F-Type yoke has the dimensions specified in Standard S-143. Pockets for a hydraulic cushioning unit may have "EOC-9" dimensions of about 38¾ inches described in AAR standard S-183 or EOC-10 pocket with a pocket length of about 48¾ inches described in AAR standard S-184.

Embodiments of the invention comprise a standard E-Type or F-Type yoke 17 having a nose at one end, a tail comprising a transverse tail wall opposite the nose, side walls or "straps" 16 extending from the tail wall to the nose, and an inside area between the straps 16. In the F-type yoke shown in the appended Figures, the coupler 19 is attached to the yoke with a pin 18. As known in the art, a draft gear may be positioned in the inside area of the yoke against the tail wall. The draft gear comprises a housing which at its base extends beyond the tail wall of the yoke on opposite sides and the portions of the base of the draft gear that extend beyond the tail wall of the yoke abut a force transfer member as described below. As known in the art, the draft gear comprises a spring element within the housing and a piston abutting the spring element adapted to move within the housing against a force of the spring element. Buff force on the coupler 19 is transmitted to the piston of the draft gear via a block referred to as a coupler follower.

Embodiments of the invention include a separate stack of elastomeric units for positioning behind a standard yoke to absorb additional buff forces on the coupler. The stack of elastomeric units has characteristic features, including a rear plate and a set of adjacent rigid plates with at least one elastomeric pad between adjacent rigid plates. Each individual pad and plate together are referred to as an "elastomeric unit". The metal plates of the elastomeric units may be provided with features on the edges of the plate to align the plates and to provide a compression stop to prevent compression of the elastomeric pads beyond a predetermined amount. In embodiments, the elastomeric units are compressed and secured together by at least one connecting rod. For example, and not by way of limitation, a rod may pass through the center of each plate and each elastomeric pad and may be secured to the rear plate with a nut. The head of the connecting rod may be mounted flush using a front plate on the other end of the stack to facilitate positioning behind the yoke. In this embodiment, a recess in the front plate is provided for mounting a connecting rod flush with the front plate. Alternatively, a recess may be provided in the transverse wall of the force transfer member to receive the head of the connecting rod. In embodiments, the elastomeric unit(s) of a stack substantially fill a vertical cross section of the sill to help align the elastomeric units in the sill. Each elastomeric pad may be circular when viewed in plan, having an outer diameter and an "inner diameter" which defines a through hole adapted to receive a center rod.

The overall longitudinal dimension of a stack is arbitrary depending on the number of pads and the spatial requirements of the pocket. In embodiments, the stack of elastomeric units and the force transfer member are adapted to fit together in a pocket adapted for a second draft gear behind the yoke, i.e., a total of about 31¾ inches. In such embodiments, the force transfer member may have a length in a range of about 8 inches to about 10 inches and the stack of elastomeric units may have a length in an installed state, in a range of about 21.0 inches to about 23.0 inches. A stack of this length will supply about 5-5½ inches draft gear in a standard sill. The stacks of elastomeric units are substantially as described in co-pending application Ser. No. 15/814,853, filed Nov. 16, 2017 and Ser. No. 16/133,085, filed Sep. 17, 2018, which are incorporated by reference, but adapted for use with a standard yoke.

Force is transmitted between the stack of elastomeric units and the draft gear via a force transfer member, which is preferably a single piece metal (such as cast iron or steel), having side walls and a transverse wall between the side walls. This shape permits the transverse wall to be aligned with the tail wall of the yoke while the side walls of the force transfer member abut the base of the housing of the draft gear. The length of the sidewall creates distance between the tail wall of the yoke and the transverse wall of the force transfer member, to allow for the full 3.25" of conventional draft gear travel and the thickness of the rear wall of the yoke, to prevent the yoke tail wall from contacting the force transfer member. If a smaller draft gear is used, the force transfer member may be shortened to allow for 2½ inches of travel, for example.

In embodiments, the force transfer member is connected to a rear plate of the stack by at least one rod which passes through the elastomeric units and attaches the rear plate to the force transfer member. In other embodiments, the stack of elastomeric units is sandwiched between front and rear plates and is separate from the force transfer member, positioned adjacent and immediately behind the force transfer member.

Figure 2:
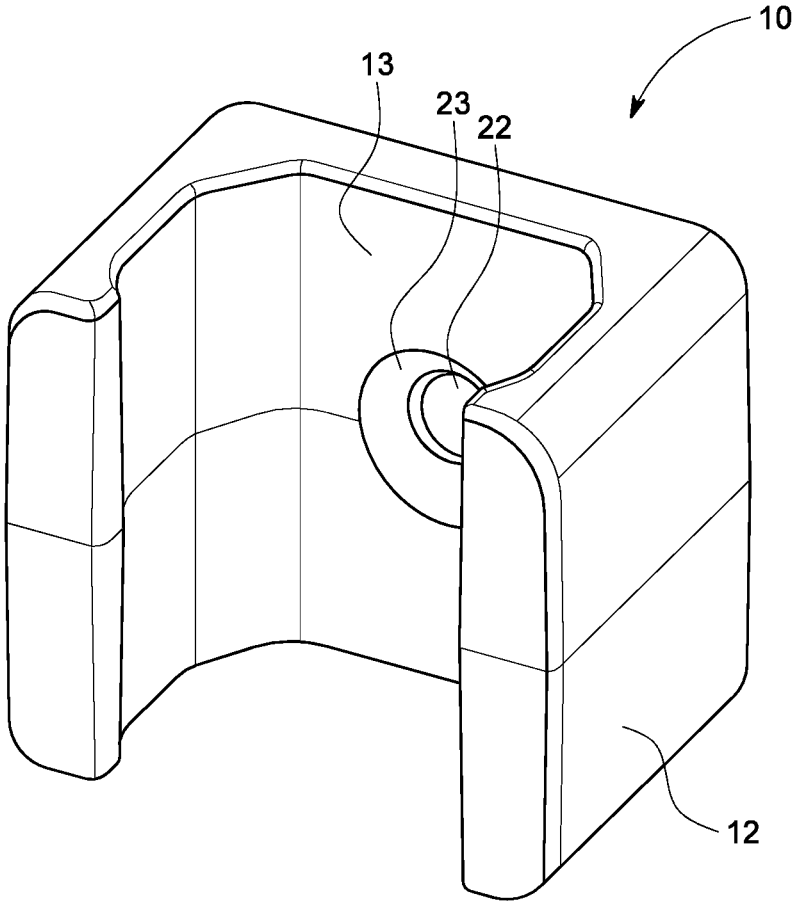
FIG. 2 depicts a force transfer member of a hybrid cushioning unit according to an embodiment of the invention.

In the embodiment shown in FIG. 2, force transfer member 10 comprises side walls 12, and a transverse wall 13. In the embodiment shown, a draft angle 31, best shown in FIG. 3A, may be provided where the side walls of the force transfer member meet the transverse wall. Aperture 22 in transverse wall 13 accommodates connecting rod 32. In the embodiment shown, aperture 22 is provided with a recess 23 around aperture 22 so that the head of the rod may be mounted flush with the inside of the force transfer member as shown in the side cross section of FIG. 3A. Although frustrum shaped in FIG. 2, the recess 23 may have other shapes that would prevent the head of connecting rod 32 from protruding above the surface of transverse wall 13.

FIG. 1 shows force transfer member 10 assembled behind a standard yoke 17 with a draft gear 14 and a stack 11 of elastomeric units. Side walls 12 of force transfer member 10 engage the base of draft gear 14. The arrangement depicted allows for buff travel of about 8.25 inches (3¼ inches from the draft gear and 5.0 inches from the stack of elastomeric units. Energy absorption of the apparatus shown in an impact event may be in a range of about 100 ft-klbs to about 215 ft-klbs. In embodiments the hybrid cushioning unit absorbs about 160 ft klbs to about 215 ft-klbs. This compares favorably to a cushioning system using two standard draft gears in tandem, as that system would not exceed 6.50 inches of travel and may not absorb more than 100 ft-klbs of energy. The stack of elastomeric pads has greater energy capacity than a draft gear of the same length and will continue to exhibit deflection at high energy absorption, which makes for a softer impact. In the embodiment shown, the force transfer member has a length of about 9.375 inches, adapted to be installed with an AAR standard F-Type yoke. Appropriate changes to these dimensions to adapt another standard yoke and draft gear design for use with a stack of elastomeric units according to the invention would be within the skill of the art.

Figure 3A:
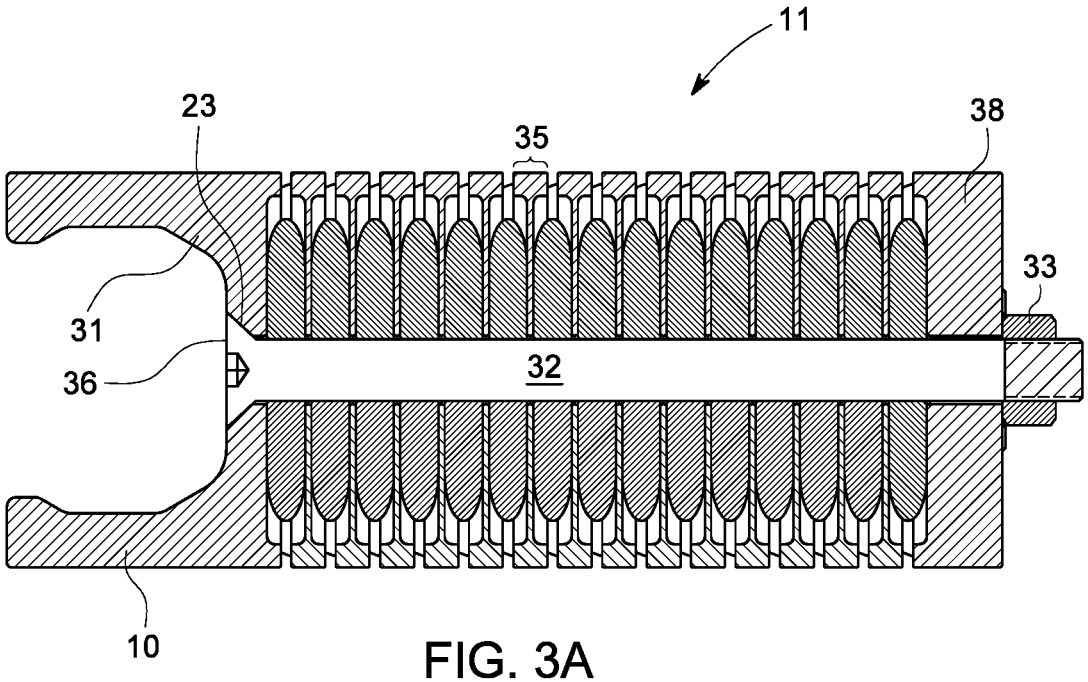
FIG. 3A and FIG. 3B depict alternative ways to secure a stack of elastomeric units to the force transfer member according to embodiments of the invention.
Figure 3B:
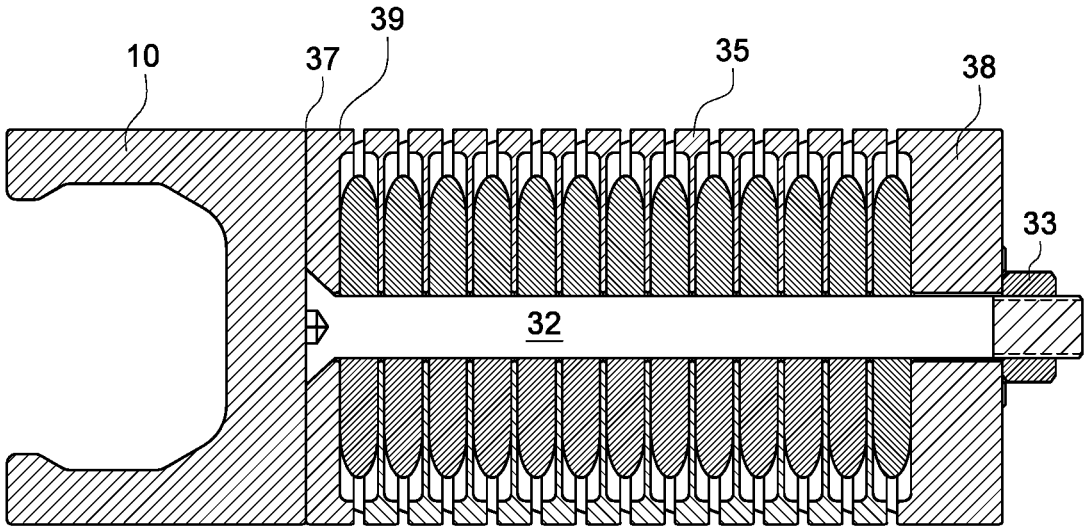

FIG. 3A and FIG. 3B depict alternative ways to position stack 11 of elastomeric units behind a force transfer member. In FIG. 3A, force transfer member 10 is provided with an aperture 22 having frustoconical sidewalls 23 to permit connecting rod 32 to be inserted through force transfer member 10 and through stack 11 of elastomeric units 35 with a flush mount at surface 36 on the inside of force transfer member 10. In the embodiment shown in FIG. 3A, an elastomeric pad abuts force transfer member 10 and rear plate 38 is secured to stack 11, including the force transfer member, by nut 33. In the alternative embodiment depicted in FIG. 3B, connecting rod 32 is flush mounted to front plate 39 of stack 11, which provides a flat interface 37 between force transfer member 10 and stack 11 so that stack 11 is not attached.

In embodiments, each plate and elastomeric pad has a hole in the center to receive connecting rod 32. However, this arrangement may be varied without departing from the scope of the invention. For example, pads may have a rectangular shape, or an array of pads, of any shape, may be used. The rectangular vertical cross section of elastomeric units 35 and force transfer member 10 substantially fill a standard sill. This arrangement facilitates alignment of the cushioning apparatus in the sill. The length of stack 11 is determined by the number of elastomeric units 35 and the configuration of stack 11 with the force transfer member. Thus, in FIG. 3A a total of 15 pads and 14 plates provides the same overall length as 13 pads and 12 plates in FIG. 3B. As would be apparent to a person of ordinary skill in the art, an additional elastomeric pad and associated plate may be added to a stack, and that will increase the travel and create softer cushioning, but at the expense of more space being required in the sill for installation.

As described in the aforesaid co-pending application Ser. No. 15/814,853, the rigid plates may be adapted to prevent over-compression of the elastomeric pads. For example, the plates may be made of cast or fabricated metal such as steel, and a stop surface may be provided on the periphery of the plate. Protrusions on the periphery of each plate permit a nesting arrangement of elastomeric units in stacks, which also contributes to alignment of the elastomeric units. Metal-to-metal contact on the stop surfaces occurs when an elastomeric pad between two adjacent plates is compressed a predetermined amount, such as 20-80%, and in embodiments 20-60%, of the uncompressed thickness of the pads. In embodiments, the pads in the front or draft stack compress about 0.5 inches (from their uncompressed thickness prior to installation) before metal to metal contact prevents further compression. In embodiments, the elastomeric pads are pre-stressed on installation. In embodiments, a protrusion on an elastomeric pad mates with a feature on an adjacent rigid plate to align the elastomeric units For example, and not by way of limitation, the uncompressed thickness of a pad may be about 1.70 inches and the outer diameter may be about 8.82. Compressed for installation with a force of about 32 klb, the installed thickness of the pads is about 1.24 inches. Under full compression, with metal-to-metal contact of plates preventing further compression of pads, the pad thickness may be about 0.91 inches and the outside diameter may reach 10.63 inches. Thus, in embodiments, the pads and plates are designed to allow compression of 20-80 percent, and in embodiments 40-60 percent, where the amount that the pad is compressed at full compression is expressed as a percentage of the uncompressed thickness of the pad, prior to installation. The same elastomeric material may be used for the elastomeric pads in the draft stack as in the buff stack, such as a thermoplastic elastomer. In certain non-limiting embodiments, the pads may be made of thermoplastic polyester, such as Arnitel® thermoplastic copolyester elastomer from DSM and Hytrel® thermoplastic polyester from Dupont. Suitable materials will typically have a Shore D durometer hardness of 40-70 and must have reasonably consistent properties across a temperature range that would be encountered during use.

The description of the foregoing preferred embodiments is not to be considered as limiting the invention, which is defined according to the appended claims. The person of ordinary skill in the art, relying on the foregoing disclosure, may practice variants of the embodiments described without departing from the scope of the invention claimed. A feature or dependent claim limitation described in connection with one embodiment or independent claim may be adapted for use with another embodiment or independent claim, without departing from the scope of the invention.

What is claimed is:

1. An end-of-car cushioning apparatus for a railway car, comprising:

a yoke having a nose at one end, a tail comprising a transverse tail wall at an end opposite the nose, straps extending from the transverse tail wall to the nose, and an inside area between the straps;

a draft gear positioned in the inside area of the yoke, the draft gear having a housing, a spring element within the housing, and a piston abutting the spring element and adapted to move within the housing against a force of the spring element, the housing having a base extending on opposite sides beyond the transverse tail wall of the yoke and beyond side edges of the straps;

a force transfer member having two side walls that are disposed parallel to each other and a transverse wall between the two side walls, the transverse wall aligned with the transverse tail wall of the yoke, a vertical edge of each side walls of the force transfer member abutting the base of the housing on opposite sides of the transverse tail wall of the yoke, the two side walls having a distance between them to receive the tail of the yoke;

a stack of elastomeric units comprising at least two elastomeric units secured to one another by a connecting rod passing through the elastomeric units, each elastomeric unit comprising an elastomeric pad on a surface of a rigid plate aligned with the transverse tail wall, wherein one end of said stack is positioned against the transverse wall of the force transfer member, the stack extends from the yoke in a direction away from the nose, and each rigid plate of the stack has substantially same vertical cross-sectional area.

2. The end-of-car cushioning apparatus according to claim 1, wherein the yoke is an AAR standard yoke and the inside area of the yoke has a length along a longitudinal axis of the yoke of at least 26 inches to accommodate the draft gear.

3. The end-of-car cushioning apparatus according to claim 2, wherein the stack of elastomeric units comprises 10 to 15 plates and 11 to 16 respective elastomeric pads corresponding to said 10 to 15 plates, wherein a combined length of the force transfer member and the stack of elastomeric units in an installed state is about 30 to 33 inches.

4. The end-of-car cushioning apparatus according to claim 1, wherein at least one of rigid plates comprises an edge portion around the elastomeric pad, said edge portion having a front surface feature that cooperates with a rear surface in an edge portion of an adjacent rigid plate; and wherein at full compression of the stack, contact between the front surface feature and the rear surface of adjacent rigid plates prevents compression of an elastomeric pad between them beyond a predetermined thickness.

5. The end-of-car cushioning apparatus according to claim 1, wherein the transverse wall of the force transfer member comprises an aperture, and wherein said connecting rod passes through the aperture in the force transfer member and through each of the elastomeric units and is secured with a nut.

6. The end-of-car cushioning apparatus according to claim 5, further comprising a recess around the aperture adapted to receive a head of the connecting rod for a flush mounting of the connecting rod on the transverse wall of the force transfer member.

7. The end-of-car cushioning apparatus according to claim 1, having an energy capacity of about 100 ft klbs to about 215 ft klbs in an impact event.

8. The end-of-car cushioning apparatus according to claim 1, wherein the stack of elastomeric units further comprises a rear plate, and a front plate, the stack of elastomeric units compressed between the front plate and the rear plate; wherein the connecting rod is secured to the rear plate by a nut and is received in a recess in the front plate providing a flush mounting and flat interface between the force transfer member and the stack of elastomeric units.

9. A force transfer member for a cushioning apparatus of a railway car, the force transfer member comprising:

two parallel side walls having a distance between them to accommodate a tail of a railway car yoke; and a transverse wall between the two parallel side walls;

each side wall is sized to abut a respective portion of a railway car draft gear extending beyond the tail of the railway car yoke on opposite sides during operation of the cushioning apparatus when the force transfer member is positioned to absorb buff forces;

the force transfer member is a single piece of metal.

10. The force transfer member according to claim 9, further comprising a draft angle where each side wall of the force transfer member meets the transverse wall.

11. The force transfer member according to claim 9, having a distance between the side walls to accommodate a tail of an association of American railroads (AAR) standard F-Type or E-Type yoke.

12. The force transfer member according to claim 9, further comprising a stack of 2 to 10 elastomeric units attached to the force transfer member, wherein a vertical cross section of the stack substantially fills the vertical cross section of a railway car sill.

13. The force transfer member according to claim 9, wherein the transverse wall comprises an aperture, the aperture having a recess adapted to provide a flush mount for a connecting rod, the connecting rod is designed to pass through the aperture in the transverse wall and attach a stack of elastomeric units to the force transfer member.

14. The force transfer member according to claim 13, wherein the connecting rod is further designed to pass through apertures in each elastomeric unit within the stack of elastomeric unit.

15. An end-of-car cushioning apparatus, comprising: a force transfer member made of a single metal piece, having two substantially parallel side walls having a distance between the two substantially parallel side walls to accommodate a tail of a railway car yoke, each side wall of the force transfer member being sized to abut a respective portion of a railway car draft gear received in the railway car yoke and extending beyond the tail of the railway car yoke on opposite sides of the tail, and further having a transverse wall between the two substantially parallel side walls of the force transfer member, the transverse wall having an aperture receiving, during operation of the end-of-car cushioning apparatus when the force transfer member is positioned to absorb buff forces, a connecting rod configured to pass through the aperture and through a stack of elastomeric units to attach the force transfer member to the stack of elastomeric units.

16. The end-of-car cushioning apparatus according to claim 15, further comprising the stack of elastomeric units, wherein the stack of elastomeric units comprises:

a rear plate at one end of the stack;

a nested set of rigid metal plates between the rear plate and the force transfer member;

an elastomeric pad between each rigid metal plate of said nested set of rigid metal plates and between the rear plate and an adjacent rigid metal plate, wherein the transverse wall of the force transfer member, the rear plate and each plate in said stack of elastomeric units all have substantially same vertical cross-sectional dimension, which substantially fills a vertical cross section of a railway car center sill during operation of the end-of-car cushioning apparatus installed in the railway car center sill.

17. The end-of-car cushioning apparatus according to claim 15, further comprising the stack of elastomeric units, wherein the stack of elastomeric units comprises between 10 and 15 plates and between 11 to 16 corresponding elastomeric pads.

18. The end-of-car cushioning apparatus according to claim 17, wherein the force transfer member and stack of elastomeric units together are adapted to fit behind a conventional yoke in a pocket sized to receive a conventional draft gear.

* * * * *